US008378959B2

(12) United States Patent
Yeo et al.

(10) Patent No.: US 8,378,959 B2
(45) Date of Patent: Feb. 19, 2013

(54) METHOD OF DIMMING LIGHT SOURCES, LIGHT SOURCE APPARATUS FOR PERFORMING THE METHOD, AND DISPLAY APPARATUS HAVING THE LIGHT SOURCE APPARATUS

(75) Inventors: Dong-Min Yeo, Daegu (KR); Gi-Cherl Kim, Yongin-si (KR); Se-Ki Park, Suwon-si (KR); Byoung-Dae Ye, Yongin-si (KR)

(73) Assignee: Samsung Display Co., Ltd. (KR)

( * ) Notice: Subject to any disclaimer, the term of this patent is extended or adjusted under 35 U.S.C. 154(b) by 892 days.

(21) Appl. No.: 12/499,716

(22) Filed: Jul. 8, 2009

(65) Prior Publication Data

US 2010/0007589 A1 Jan. 14, 2010

(30) Foreign Application Priority Data

Jul. 14, 2008 (KR) ..... 10-2008-0068098

(51) Int. Cl.
*G09G 3/36* (2006.01)

(52) U.S. Cl. ..... 345/102; 345/83; 345/88

(58) Field of Classification Search ..... 345/87–102, 345/690, 204, 82–83
See application file for complete search history.

(56) References Cited

U.S. PATENT DOCUMENTS

| | | | | |
|---|---|---|---|---|
| 2006/0290648 | A1* | 12/2006 | Yun et al. | 345/102 |
| 2007/0109240 | A1* | 5/2007 | Jung | 345/87 |
| 2007/0216636 | A1* | 9/2007 | Lo | 345/102 |
| 2007/0285379 | A1* | 12/2007 | Jung et al. | 345/102 |
| 2009/0002400 | A1* | 1/2009 | Ha et al. | 345/690 |
| 2009/0021469 | A1* | 1/2009 | Yeo et al. | 345/102 |
| 2009/0058876 | A1* | 3/2009 | Wang et al. | 345/590 |
| 2010/0085297 | A1* | 4/2010 | De Greef | 345/102 |

FOREIGN PATENT DOCUMENTS

| | | |
|---|---|---|
| JP | 2007-034251 | 2/2007 |
| KR | 2007-0052111 | 5/2007 |
| KR | 2007-0117847 | 12/2007 |

* cited by examiner

*Primary Examiner* — Hong Zhou
(74) *Attorney, Agent, or Firm* — Innovation Counsel LLP

(57) ABSTRACT

A light source panel according to an embodiment includes a plurality of light-emitting parts having a plurality of light-emitting substances to be divided into a predetermined number of partial areas. A light source driving part provides each of the light-emitting substances with a current. An adaptive dimming control part receives an image signal from an external device and sets the light-emitting parts into a first dimming block corresponding to a first color class of the first image signal or a second dimming block corresponding to a second color class of the first image signal to control the backlight assembly, in order to prevent color artifacts from being generated at a boundary area between the first dimming block and the second dimming block, the adaptive dimming control part controlling the backlight assembly, so that the first dimming block performs a second dimming operation.

19 Claims, 6 Drawing Sheets

METHOD OF DIMMING LIGHT SOURCES, LIGHT SOURCE APPARATUS FOR PERFORMING THE METHOD, AND DISPLAY APPARATUS HAVING THE LIGHT SOURCE APPARATUS

CROSS REFERENCE TO RELATED APPLICATIONS

This application claims priority under 35 U.S.C. §119 to Korean Patent Application No. 2008-68098, filed on Jul. 14, 2008 in the Korean Intellectual Property Office (KIPO), the contents of which are herein incorporated by reference in their entirety.

BACKGROUND

1. Technical Field

Example embodiments of the present invention relate to a method of dimming light sources, a light source apparatus for performing the method, and a display apparatus having the light source apparatus. More particularly, example embodiments of the present invention relate to a method for independently dimming a plurality of light-emitting blocks, a light source apparatus for performing the method, and a display apparatus having the light source apparatus.

2. Related Art

Generally, a liquid crystal display (LCD) apparatus includes an LCD panel displaying an image using optical transmittance of liquid crystal molecules and a backlight assembly disposed below the LCD panel to provide the LCD panel with light.

The typical LCD panel includes an array substrate, a color filter substrate, and a liquid crystal layer. The array substrate includes a plurality of pixel electrodes and a plurality of thin-film transistors (TFTs) electrically connected to the pixel electrodes. The color filter substrate faces the array substrate and has a common electrode and a plurality of color filters. The liquid crystal layer is interposed between the array substrate and the color filter substrate.

When an electric field generated between the pixel electrode and the common electrode is applied to the liquid crystal layer, an arrangement of liquid crystal molecules of the liquid crystal layer is altered to change optical transmissivity, so that an image is displayed. For example, the LCD panel may realize a white image of a high luminance when an optical transmittance is increased to a maximum, and the LCD panel realizes a black image of a low luminance when the optical transmittance is decreased to a minimum.

The LCD apparatus may, however, have a disadvantage of glare in comparison with other types of display apparatuses such as a cathode ray tube (CRT), or a plasma display panel (PDP), for example. The LCD apparatus requires an external light in order to display an image since an LCD panel does not emit light by itself. Thus, the LCD apparatus may have different luminance distribution characteristics than those of the CRT or the PDP. A user may experience eye fatigue due to the different luminance distribution characteristics.

Recently, in order to prevent the contrast ratio of an image from being decreased and to minimize power consumption, a method of local dimming of a light source has been developed, which controls amounts of light according to position to drive a light source. In the method of local dimming of the light source, the light source is divided into a plurality of light-emitting blocks to control the amounts of light of the light-emitting blocks in correspondence with dark and light areas of a display area of the LCD panel corresponding to the light-emitting blocks. For example, a light-emitting block corresponding to a display area displaying a black image is driven at a low luminance (e.g., turned off), and a light-emitting block corresponding to a display area displaying a white image is driven at a high luminance. The local dimming method may be employed to solve the disadvantage of glare. The local dimming method may have characteristics capable of controlling luminance by emitting blocks, so that an effect such as driving characteristics of a CRT or a PDP may be realized.

Recently, in order to enhance contrast ratio (CR), to decrease power consumption, and to increase color reproducibility, interest in local dimming has increased in products employing light-emitting diodes (LED). For example, a full screen area is divided into a plurality of blocks having uniform size to compensate gamma characteristics generated due to light leakage of an LCD panel through each block luminance or color dimming, so that the CR is enhanced. Moreover, the color reproducibility is increased and the power consumption is reduced.

SUMMARY

Example embodiments of the present invention provide a method of dimming a light source that is effectively capable of a local dimming which individually drives a plurality of light-emitting blocks. Example embodiments of the present invention also provide a light source apparatus for performing the above-mentioned method. Example embodiments of the present invention further provide a liquid crystal display (LCD) apparatus having the above-mentioned light source apparatus.

According to one embodiment of the present invention, there is provided a method of dimming of a light source. In the method, when an image signal is input from an external device, a plurality of light-emitting parts of a light-emitting panel is set into a plurality of first dimming blocks corresponding to a first color class of the image signal or a plurality of second dimming blocks corresponding to a second color class of the image signal. To generate red, green, and blue (RGB) representative values, a plurality of RGB representative values is calculated from RGB values from the image signal corresponding to each of the first and second dimming blocks. A total-multiplication value is calculated by using the RGB representative values corresponding to the first dimming blocks and the RGB representative values corresponding to one or more second dimming blocks adjacent to the first dimming blocks. The total-multiplication value is compared with a setting value. The first dimming block is controlled to be operated as a second dimming operation, when the total-multiplication value is greater than the setting value. The first dimming block is controlled to be operated as a first dimming operation, when the total-multiplication value is smaller than or equal to the setting value.

In an example embodiment of the present invention, the total-multiplication value may be obtained by multiplying each RGB representative value corresponding to the first dimming blocks and representative values of the same color with respect to each RGB representative value of one or more second dimming blocks adjacent to a predetermined first dimming block, and then adding the multiplied representative values of the same color to each other. In an example embodiment of the present invention, each of the RGB representative values may be a mean value of red color data, a mean value of green color data, or a mean value of blue color data in correspondence with the same block. In an example embodiment of the present invention, each of the RGB representative values may be a most-frequent value of red color data, a most-frequent value of green color data, or a most-frequent value of blue color data in correspondence with the same block. In an example embodiment of the present invention, each of the RGB representative values may be a median value of red color data, a median value of green color data, or a median value of blue color data in correspondence with the same block.

According to another embodiment of the present invention, a light source apparatus includes a light source panel, a light source driving part, and an adaptive dimming control part. The light source panel includes a plurality of light-emitting parts having a plurality of light-emitting substances to be divided into a predetermined number of partial areas. The light source driving part provides each of the light-emitting substances with a current. The adaptive dimming control part receives an image signal from an external device and sets the light-emitting parts into a plurality of first dimming blocks corresponding to a first color class of the image signal or a plurality of second dimming blocks corresponding to a second color class of the image signal to control the backlight assembly, in order to prevent color artifacts from being generated at a boundary area between the first dimming blocks and the second dimming blocks, the adaptive dimming control part controlling the backlight assembly, so that a first dimming block performs a second dimming operation.

In an example embodiment of the present invention, the adaptive dimming control part may calculate each of a plurality of red, green, and blue (RGB) representative values from the image signal corresponding to each of the first and second dimming blocks, respectively; may calculate a total-multiplication value of the RGB representative values corresponding to the first dimming block and a total-multiplication value of the RGB representative value corresponding to a second dimming block adjacent to the first dimming blocks. The adaptive dimming control part may control the backlight driving part when the total-multiplication value is greater than a setting value so that the first dimming blocks perform the second dimming operation, and may control the backlight driving part when the total-multiplication value is smaller or equal to the setting value so that the first dimming blocks perform a first dimming operation. In an example embodiment of the present invention, the light-emitting part may include a red light-emitting diode (LED), a green LED, and a blue LED. The first dimming operation may be a color dimming which emits color light by using the red, green, and blue LEDs. In an example embodiment of the present invention, the light-emitting part may include a red LED, a green LED, and a blue LED. The second dimming operation may be a luminance dimming which emits a white light by using the red, green, and blue LEDs.

In an example embodiment of the present invention, the adaptive dimming control part may control that the predetermined area performs a first dimming operation when the second representative value is smaller than or equal to the first representative value.

According to still another embodiment of the present invention, an LCD apparatus includes an LCD panel, a backlight assembly, and an adaptive dimming control part. The LCD panel displays images using a combination of a variably modifiable liquid crystal layer and a variably modifiable backlighting assembly. The backlight assembly includes a plurality of light-emitting parts having a plurality of light-emitting substances (e.g., differently colored light-emitting elements), where the backlighting area of the backlight assembly is divided into a predetermined number of partial areas (dimmable blocks), the backlight assembly providing the LCD panel with light. The adaptive dimming control part receives an image signal from an external device and establishes the operating modes of different ones of the light-emitting parts as belonging either to a first plurality of first dimming blocks operating in accordance with a first color class (a first backlighting scheme) based on the image signal or as belonging to a second plurality of second dimming blocks operating in accordance with a second color class (a second backlighting scheme) based on the image signal as part of the control of the backlight assembly. The selection of the one backlighting scheme or the other may be performed so as to prevent color artifacts from being generated at a boundary area between the first dimming blocks (operating according to the first backlighting scheme; e.g., a colored backlighting scheme) and the second dimming blocks (operating according to the second backlighting scheme; e.g., a non-colored or white backlighting scheme). More specifically, a switch from a colored backlighting scheme to a non-colored or white backlighting scheme can be performed by the adaptive dimming control part controlling the backlight assembly, so that a first dimming block which previously performed a first dimming operation (e.g., a colored backlighting scheme) instead performs a second dimming operation (e.g., a differently colored or white backlighting scheme).

According to a method of dimming light sources, a light source apparatus for performing the method, and a display apparatus including the light source apparatus, an operation of setting first dimming blocks is maintained or abandoned based on a color of a first dimming block and a second dimming block adjacent to the first dimming block, so that color artifacts may be prevented from being generated at the boundary area between the first dimming blocks and the second dimming blocks.

BRIEF DESCRIPTION OF THE DRAWINGS

The above and other features and advantages of embodiments of the present invention will become more apparent by describing in detail example embodiments thereof with reference to the accompanying drawings, in which.

DETAILED DESCRIPTION

Figure 1:
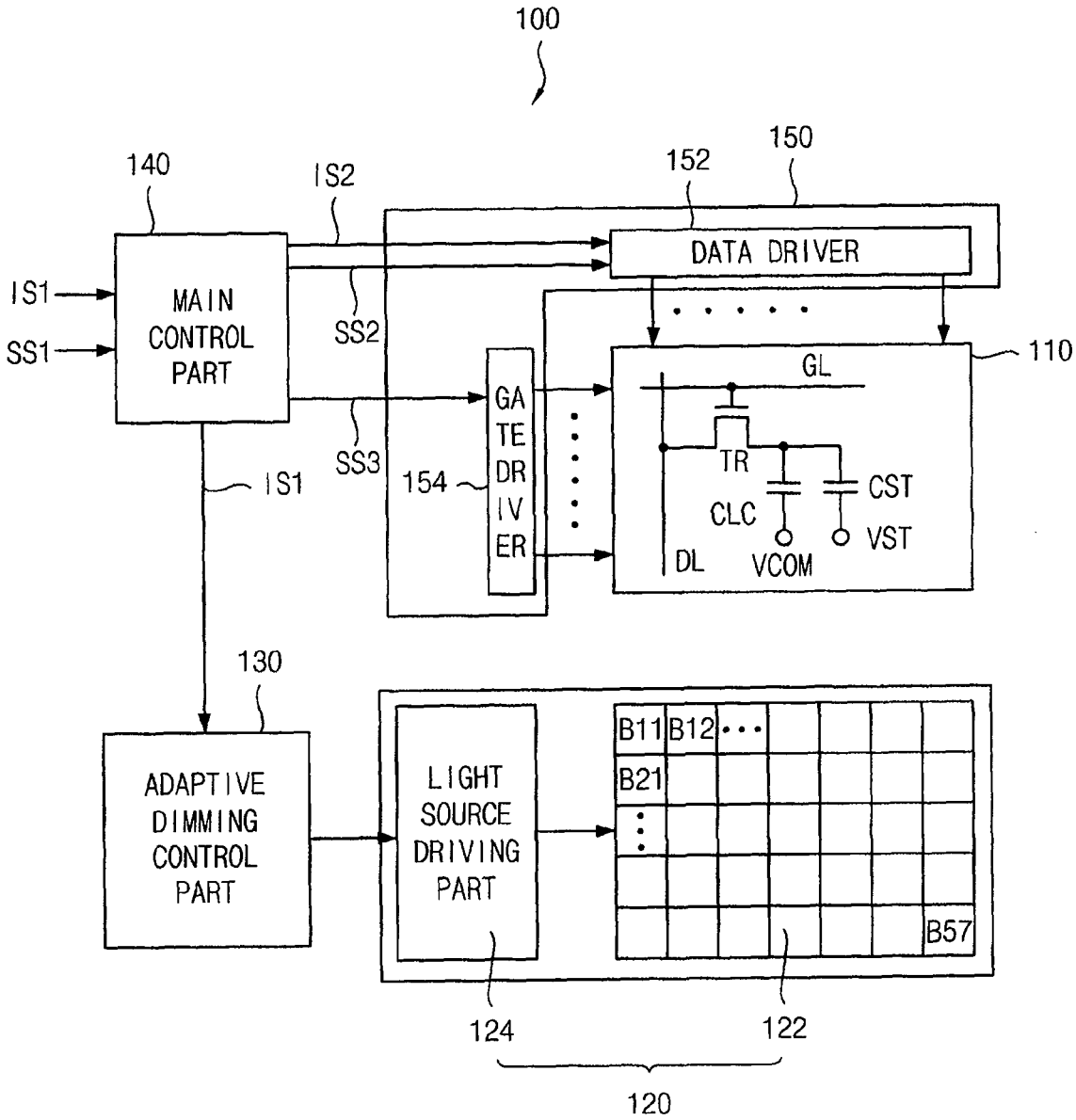
FIG. 1 is a block diagram schematically illustrating a liquid crystal display (LCD) apparatus having an adaptive dimming function according to an embodiment of the present invention.

Embodiments of the present invention are described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, for example, may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the invention are described herein with reference to cross-sectional illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present invention will be explained in detail with reference to the accompanying drawings.

FIG. 1 is a block diagram schematically illustrating a liquid crystal display (LCD) apparatus having an adaptive dimming function according to an embodiment of the present invention. Referring to FIG. 1, an LCD apparatus 100 having an adaptive dimming function according to an embodiment of the present invention includes an LCD panel 110, a backlight assembly 120, and an adaptive dimming control part 130.

Figure 3:
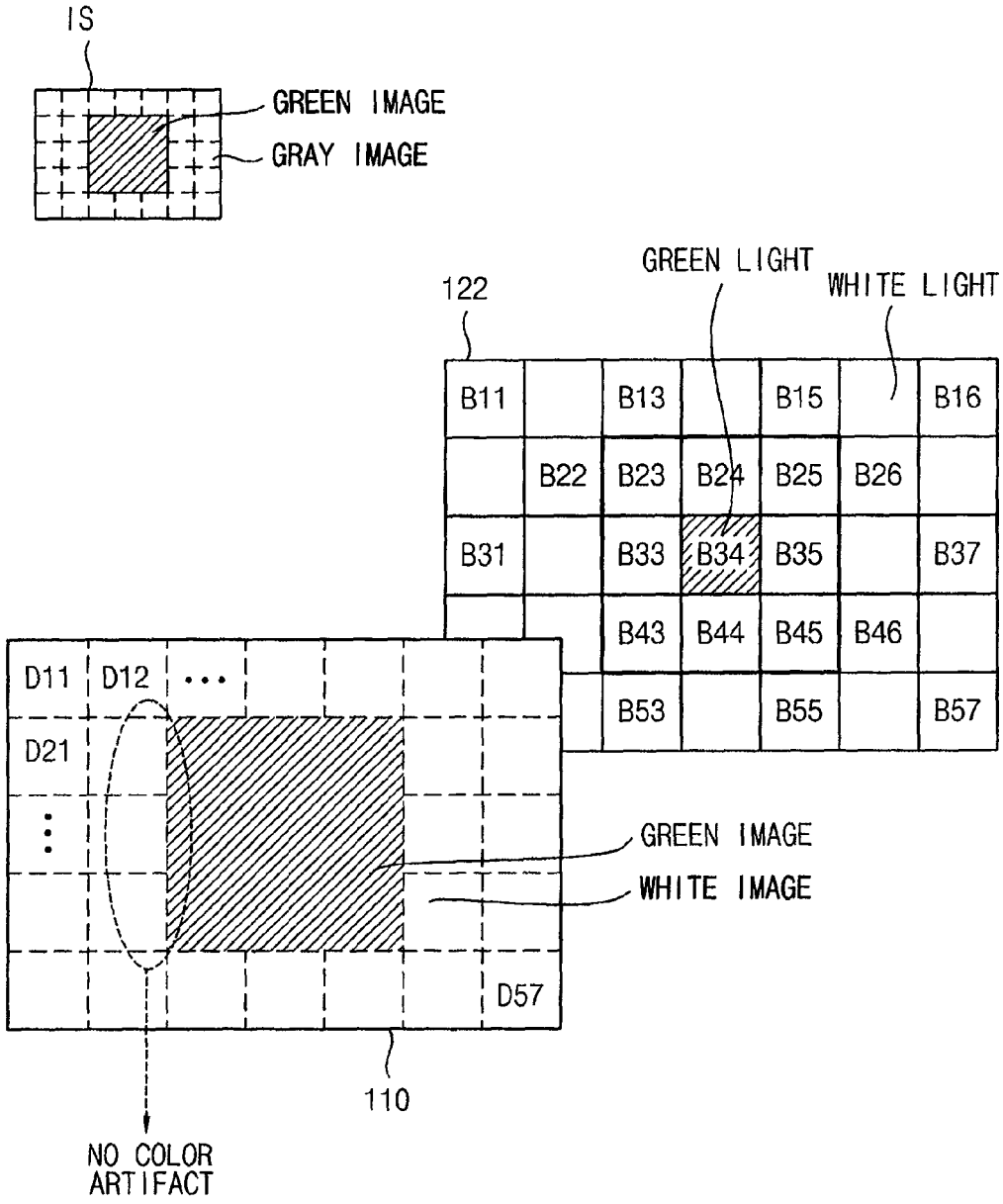
FIG. 3 is a schematic diagram schematically illustrating an example which quits a color dimming operation that is set based on an input image according to an embodiment of the present invention.
Figure 4:
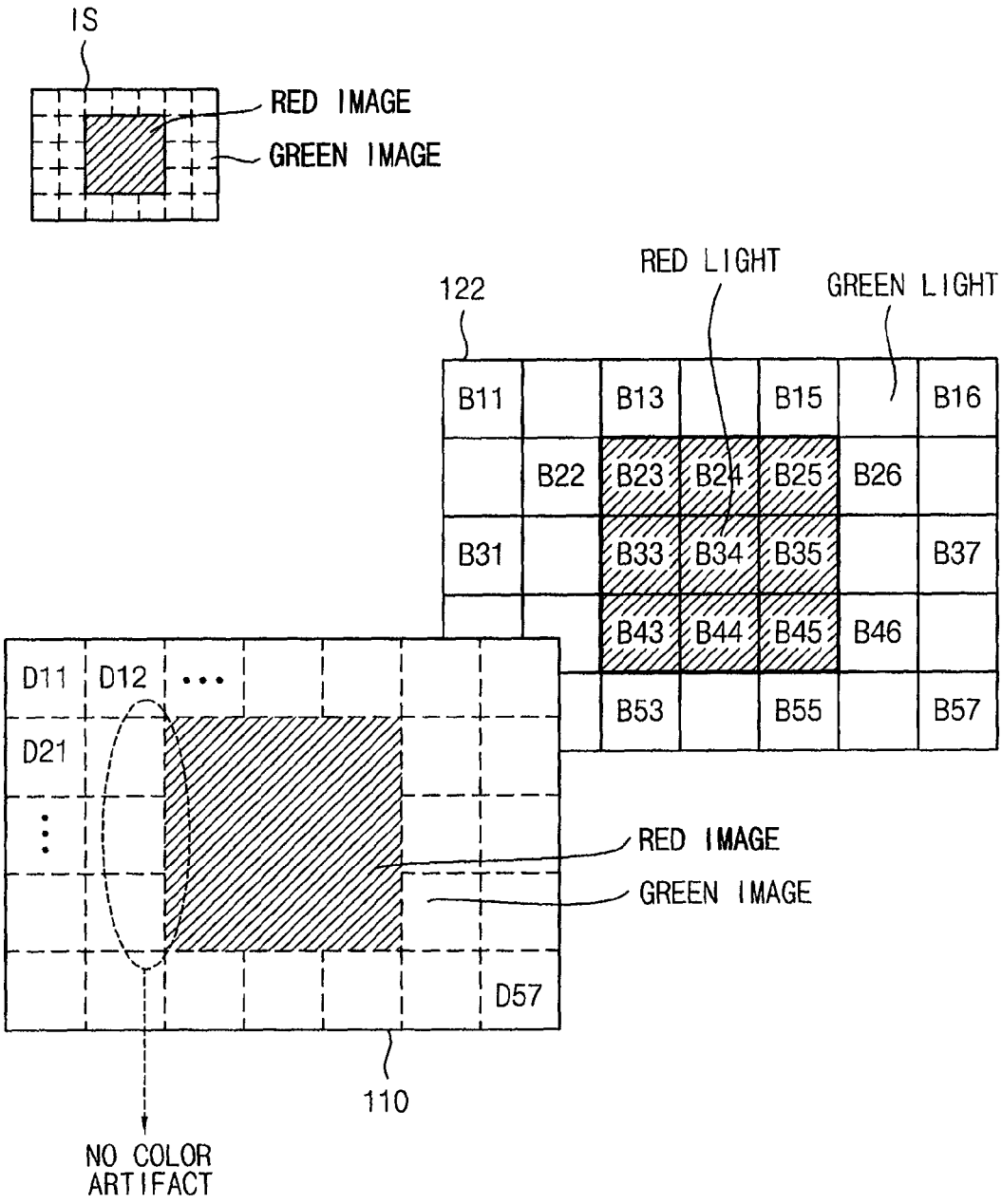
FIG. 4 is a schematic diagram schematically illustrating an example which maintains a color dimming operation that is set based on an input image according to an embodiment of the present invention.

The LCD panel 110 includes two substrates and a liquid crystal layer interposed between the two substrates to display an image. The LCD panel 110 includes a plurality of pixels displaying images. For example, the number of the pixels may be M×N (wherein 'M' and 'N' are natural numbers). Each pixel includes a switching element TR connected to a gate line GL and a data line DL, and a liquid crystal capacitor CLC and a storage capacitor CST that are connected to the switching element TR. The LCD panel 110 includes a plurality of display blocks 'Dij' as seen in FIG. 3 and FIG. 4. The number of the display blocks 'Dij' may be m×n (wherein 'm' and 'n' are natural number, $m<M$ and $n<N$).

The backlight assembly 120 provides the LCD panel 110 with light. The backlight assembly 120 includes a light-emitting panel 122 and a light source driving part 124 providing the light-emitting panel 122 with a current. The light-emitting panel 122 includes a plurality of light-emitting parts. Each light-emitting part includes a plurality of light-emitting substances (e.g., differently colored light-emitting elements), where the light-emitting panel 122 is divided into partial areas (dimmable blocks) of a predetermined number.

For example, the light-emitting panel 122 may include a printed circuit board having a plurality of light-emitting diodes (LEDs) mounted thereon. The LEDs may include a red LED, a green LED, and a blue LED. The light-emitting panel 122 includes the m×n light-emitting blocks 'Bij' in correspondence with the m×n display blocks 'Dij'. The light-emitting blocks 'B' may be disposed at a position corresponding to each display block 'D'. Each light-emitting block 'B' may include a plurality of LEDs.

As a first image signal IS1 is input from an external device, the adaptive dimming control part 130 sets the light-emitting parts into a first dimming block corresponding to a first color class of the first image signal IS1 or a second dimming block corresponding to a second color class of the first image signal IS1 to control the backlight assembly 120.

According to the present embodiment, in order to prevent color artifacts from being generated at a boundary area between the first dimming block and the second dimming block, the adaptive dimming control part 130 controls the backlight assembly 120, so that the first dimming block performs the second dimming operation.

Hereinafter, it is assumed that the first dimming block is a color dimming block performing a color dimming and the second dimming block is a luminance dimming block performing a luminance dimming. The color dimming is a dimming operation for which one of a red LED, a green LED, and a blue LED is driven to emit color light. The luminance dimming is a dimming operation for which all three of the red LED, the green LED, and the blue LED are driven to emit a white light.

The LCD apparatus 100 further includes a main control part 140 and a panel driving part 150. The main control part 140 receives a first control signal SS1 and a first image signal IS1 from an external device. The first control signal may include a vertical synchronizing signal (Vsync), a horizontal synchronizing signal (Hsync), and a data enable signal (DE). The vertical synchronizing signal (Vsync) represents a time required for displaying one frame. The horizontal synchronizing signal (Hsync) represents a time required for displaying one line of the frame. Thus, the horizontal synchronizing signal includes pulses corresponding to the number of pixels included in one line. The data enable signal (DE) represents a time required for supplying the pixel with data.

The main control part 140 converts the first image signal IS1 into a second image signal IS2 to provide to the panel driving part 150. The main control part 140 generates a second control signal SS2 and a third control signal SS3 controlling a driving timing of the LCD panel 110 by using the first control signal SS1. The panel driving part 150 drives the LCD panel 110 by using the second control signal SS2 and the second image signal IS2 that are provided from the main control part 140.

The panel driving part 150 may include a data driving part 152 and a gate driving part 154. The data driving part 152 generates a plurality of data signals by using the second control signal SS2 and the second image signal IS2, and then provides the data line DL with the generated data signals. The second control signal SS2 may include, for example, a clock signal and a horizontal start signal STH. The gate driving part 154 generates a gate signal activating the gate line GL by using the third control signal SS3, and then provides the gate line with the generated gate signal. The third control signal SS3 may include, for example, a vertical start signal STV.

As described above, a color determined by RGB representative values of the color dimming blocks is analyzed as a case in which color is spread to peripheral luminance dimming blocks and a case in which color is not spread to the peripheral luminance dimming blocks to maintain or abandon a color dimming operation of the predetermined color dimming block, so that color artifacts may be prevented from being generated at the boundary area between the color dimming blocks and the luminance dimming blocks.

Figure 2:
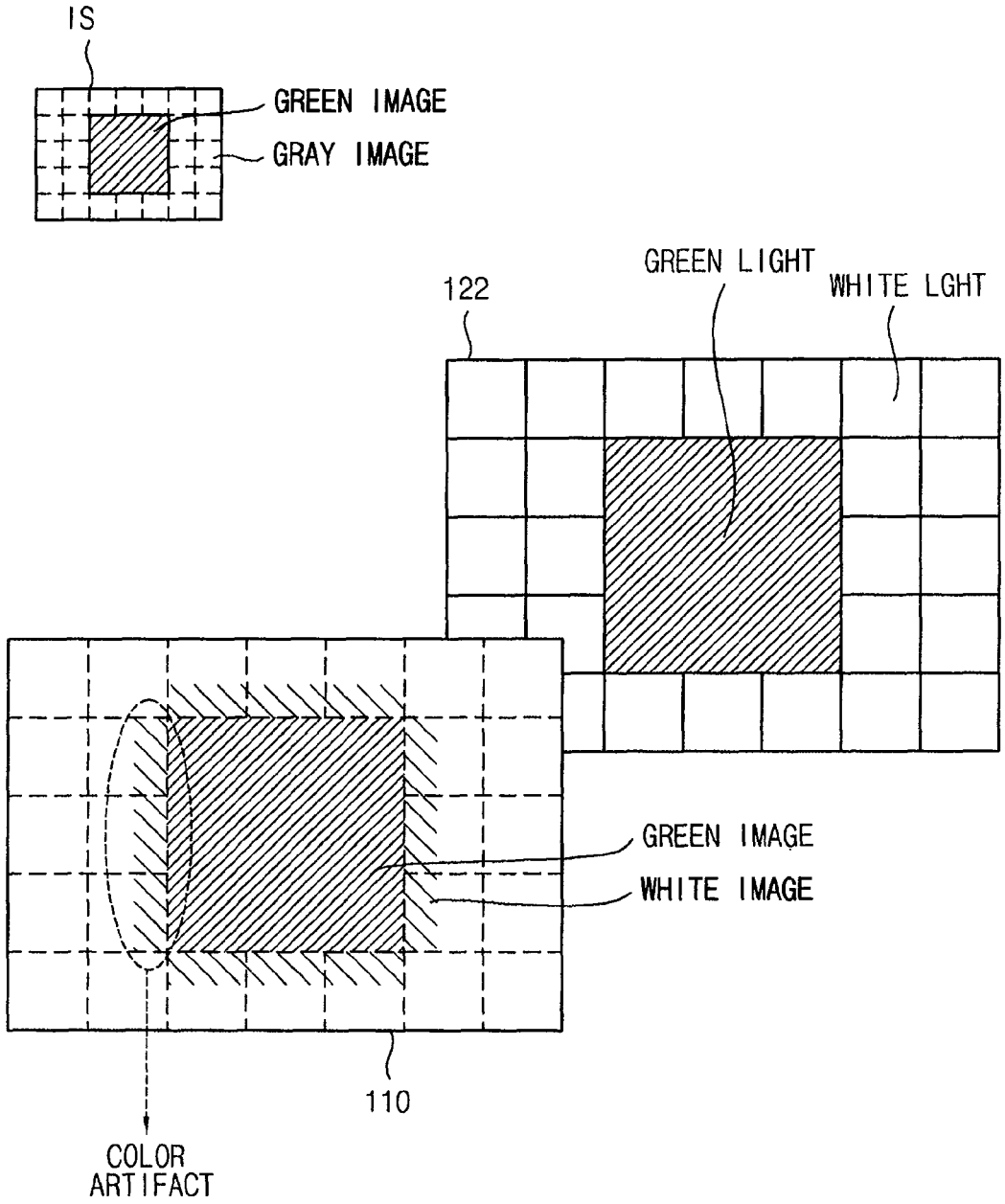
FIG. 2 is a schematic diagram schematically illustrating a color dimming and a luminance dimming that are performed based on an input image according to an embodiment of the present invention.

FIG. 2 is a schematic diagram schematically illustrating a color dimming and a luminance dimming that are performed, according to an embodiment of the present invention, based on an input image. Referring to FIG. 2, an input image 'IS' input from an external device has a green color in correspondence with a central portion and a gray color in correspondence with a peripheral portion. For example, a color of the central portion may be defined as R=0, G=255, and B=0, and a color of the peripheral portion may be defined as R=100, G=100, and B=100.

Accordingly, a light-emitting panel may be set as color dimming, which emits a green color light in correspondence with the central portion of the input image IS, and as luminance dimming, which emits a white light in correspondence with the peripheral portion of the input image IS. In order to emit the white light, a gray-scale of light emitted from each of R, G, and B values may be, for example, R=255, G=255, and B=255. A color of the central portion, however, may be determined as R=0, G=255, and B=0. A representative G-gray-scale value of a peripheral portion may be more than a predetermined level (that is, a tuning parameter)—for example, more than 100-gray-scale—so that, when viewed, it appears that a color of the color dimming blocks is spread to the peripheral luminance dimming blocks. In other words, in a color dimming state, color artifacts, such as a color that is spread to a periphery of the color dimming blocks, may be generated in a boundary portion between the color dimming blocks and the luminance dimming blocks.

According to an embodiment of the present invention, however, a color determined by RGB representative values of the color dimming blocks may be analyzed case by case, as a case in which color is spread to peripheral luminance dimming blocks and a case in which color is not spread to the peripheral luminance dimming blocks, to readjust the color dimming blocks so that color artifacts may be prevented from being generated at the boundary area.

FIG. 3 is a schematic diagram schematically illustrating an example which, according to an embodiment of the present invention, quits a color dimming operation that is set based on an input image. Referring to FIG. 3, an input image 'IS' input from an external device has a green color in correspondence with a central portion and a gray color in correspondence with a peripheral portion. For example, a color of the central portion may be defined as R=0, G=255, and B=0, and a color of the peripheral portion may be defined as R=100, G=100, and B=100.

Accordingly, a light-emitting panel may be set as color dimming, which emits a green color light in correspondence with the central portion of the input image IS, and as luminance dimming, which emits a white light in correspondence with the peripheral portion of the input image IS. Blocks corresponding to the central portion, which is set as color dimming in FIG. 3, may be B23, B24, B25, B33, B34, B35, B43, B44 and B45, and the remaining blocks may be set as luminance dimming. In order to emit the white light, a gray-scale of light emitted from each of R, G, and B values may be, for example, R=255, G=255, and B=255. A color of the central portion, however, may be determined as R=0, G=255, and B=0. A representative G-gray-scale value of a peripheral portion may be greater than a predetermined level (that is, a tuning parameter)—for example, no more than 100-gray-scale. Thus, when viewed, color artifacts appear in which a color of the color dimming blocks is spread to peripheral luminance dimming blocks. Therefore, as shown in FIG. 3, the color dimming blocks adjacent to the luminance dimming blocks may be abandoned, and the color dimming blocks may be changed to a luminance dimming state so that the color artifacts may be prevented from being generated at the boundary area. In FIG. 3, B23, B24, B25, B33, B35, B43, B44, and B45 are set as the color dimming is set; but perform, however, a luminance dimming, and B34, that is a center block, is operated as the predetermined set color dimming.

FIG. 4 is a schematic diagram schematically illustrating an example which, according to an embodiment of the present invention, maintains a color dimming operation that is set based on an input image. Referring to FIG. 4, an input image 'IS' input from an external device has a red color in correspondence with a central portion and a green color in correspondence with a peripheral portion. For example, a color of the central portion may be defined as R=255 and G=B=0, and a color of the peripheral portion may be defined as R=0, G=255, and B=0.

Accordingly, a light-emitting panel may be set as color dimming, which emits a red color light in correspondence with the central portion of the input image IS, and as color dimming, which emits a green light in correspondence with the peripheral portion of the input image IS. In order to emit the green light, a gray-scale of light emitted from each of R, G, and B values may be, for example, R=0, G=255, and B=0. A color of the central portion, however, may be determined as R=255 and G=B=0. A representative R-gray-scale value of the peripheral portion may be no more than a predetermined level—for example, no more than 100-gray-scale—so that, when viewed, a color of the central color dimming blocks may not appear to spread to the peripheral luminance dimming blocks. Thus, the color dimming blocks adjacent to the luminance dimming blocks may be maintained to the set color dimming state. In FIG. 4, B23, B24, B25, B33, B34, B35, B43, B44, and B45 may perform the color dimming.

Figure 5:
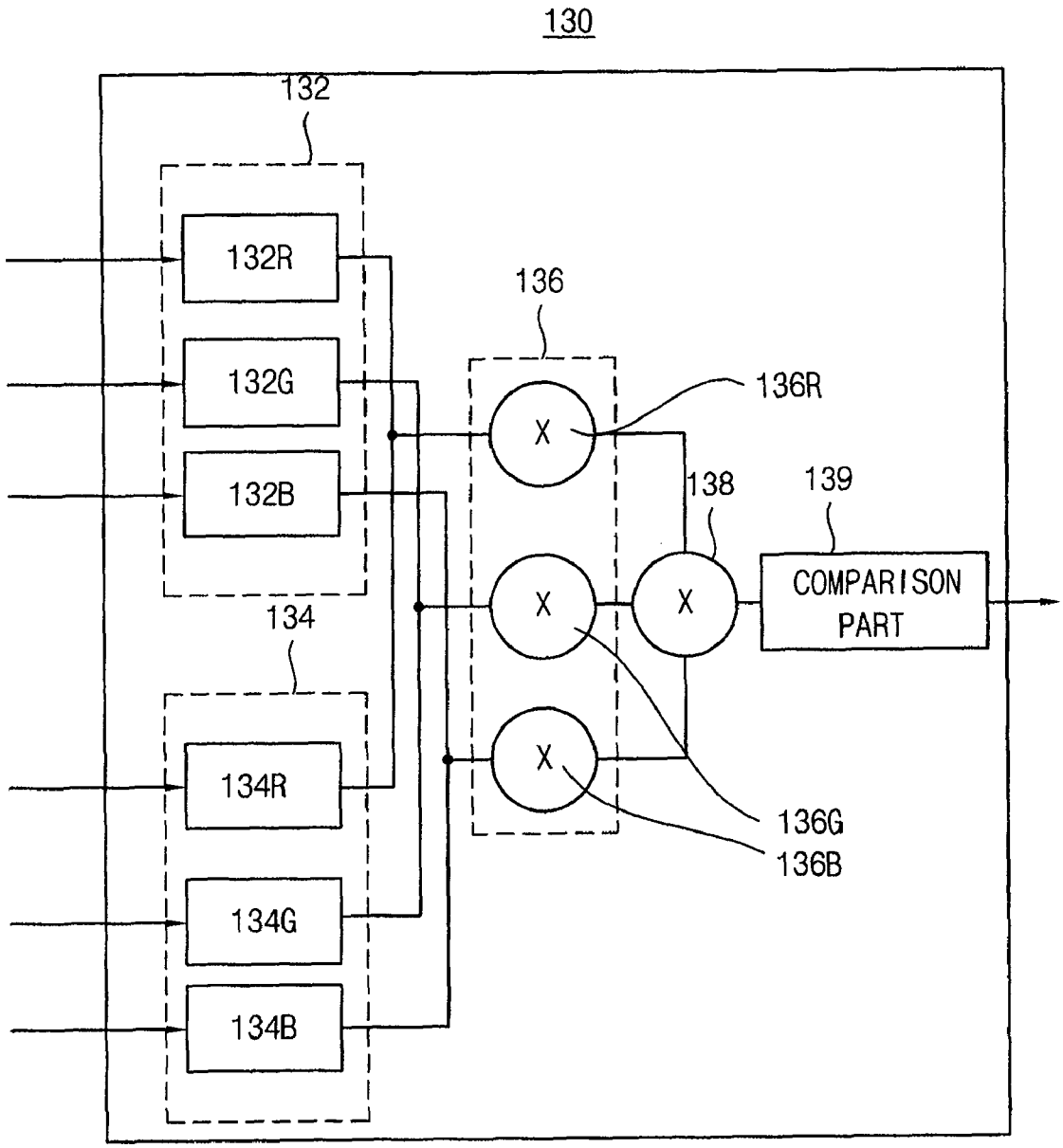
FIG. 5 is a block diagram schematically illustrating an adaptive dimming control part of FIG. 1 according to an embodiment of the present invention.

FIG. 5 is a block diagram schematically illustrating an adaptive dimming control part of FIG. 1, according to an embodiment of the present invention. Referring to FIGS. 1 and 5, an adaptive dimming control part 130 according to one or more embodiments of the present invention includes a color dimming representative value calculating part 132, a peripheral luminance dimming representative value calculating part 134, a multiplication part 136, an adder 138, and a comparison part 139.

The color dimming representative value calculating part 132 includes a first R-gray-scale representative value obtaining part 132R, a first G-gray-scale representative value obtaining part 132G and a first B-gray-scale representative value obtaining part 132B. The color dimming representative value calculating part 132 may obtain each RGB representative value from one color dimming block.

The representative value may be a gray-scale representative value corresponding to each display block. The gray-scale representative value may be, for example, a mean gray-scale value, a maximum gray-scale value, a most-frequent gray-scale value, or a median value of an image signal displayed on the display block. The most-frequent gray-scale value may, for example, be a value which is positioned at a maximum in a histogram. The median value gray-scale value may, for example, be a value calculated by a median method, which is positioned in an intermediate level when the data are arranged by size.

The first R-gray-scale representative value obtaining part 132R obtains an R-gray-scale representative value from one color dimming block, and provides the multiplication part 136 with the R-gray-scale representative value. The first G-gray-scale representative value obtaining part 132G obtains a G-gray-scale representative value from the corresponding color dimming block, and provides the multiplication part 136 with the G-gray-scale representative value. The first B-gray-scale representative value obtaining part 132B obtains a B-gray-scale representative value from the corresponding color dimming block, and provides the multiplication part 136 with the B-gray-scale representative value.

The peripheral luminance dimming representative value calculating part 134 includes a second R-gray-scale representative value obtaining part 134R, a second G-gray-scale representative value obtaining part 134G, and a second B-gray-scale representative value obtaining part 134B. The peripheral luminance dimming representative value calculating part 134 may obtain each RGB representative value from each adjacent luminance dimming block adjacent to the predetermined color dimming block, when each RGB representative value is obtained from one color dimming block by the color dimming representative value calculating part 132.

For example, when the first R-gray-scale representative value obtaining part 132R, the first G-gray-scale representative value obtaining part 132G, and the first B-gray-scale representative value obtaining part 132B obtain the first R-gray-scale representative value, the first G-gray-scale representative value, and the first B-gray-scale representative value, respectively, each of the second R-gray-scale representative value obtaining part 134R, the second G-gray-scale representative value obtaining part 134G, and the B-gray-scale representative value obtaining part 134B may obtain a second R-gray-scale representative value, a second G-gray-scale representative value, and a second B-gray-scale representative value from the corresponding color dimming block.

The multiplication part 136 multiplies the RGB representative values obtained from one color dimming block by the color dimming representative value obtaining part 132 and the RGB representative values obtained from one luminance dimming block adjacent to the predetermined color dimming block by the peripheral luminance dimming representative value obtaining part 134, and provides the adder 138 with the total-multiplication value. The multiplication part 136 may include a first multiplier 136R, a second multiplier 136G, and a third multiplier 136B so as to multiply representative values of the same color.

Accordingly, the first multiplier 136R multiplies a first R-gray-scale value obtained from a color dimming block and a second R-gray-scale value obtained from one of the luminance dimming blocks of the peripheral luminance dimming blocks adjacent to the predetermined color dimming block, and provides the adder 138 with the multiplied R-gray-scale value. The second multiplier 136G multiplies a first G-gray-scale value obtained from a color dimming block and a second G-gray-scale value obtained from one of the luminance dimming blocks of the peripheral luminance dimming blocks adjacent to the predetermined color dimming block, and provides the adder 138 with the multiplied G-gray-scale value. The third multiplier 136B multiplies a first B-gray-scale value obtained from a color dimming block and a second B-gray-scale value obtained from one of the luminance dimming blocks of the peripheral luminance dimming blocks adjacent to the predetermined color dimming block, and provides the adder 138 with the multiplied B-gray-scale value.

The adder 138 adds the multiplied gray-scale values provided from the first to third multipliers 136R, 136G and 136B, respectively, and provides the comparison part 139 with the added gray-scale value.

The comparison part 139 may provide the light source driving part 124 with a first control signal or a second control signal, based on the added gray-scale value provided from the adder 138. The first control signal may control that the predetermined color dimming block that is set as color dimming is to maintain color dimming, and the second control signal may control that the predetermined color dimming block that is set as color dimming is to abandon the color dimming to operate as luminance dimming.

Figure 6:
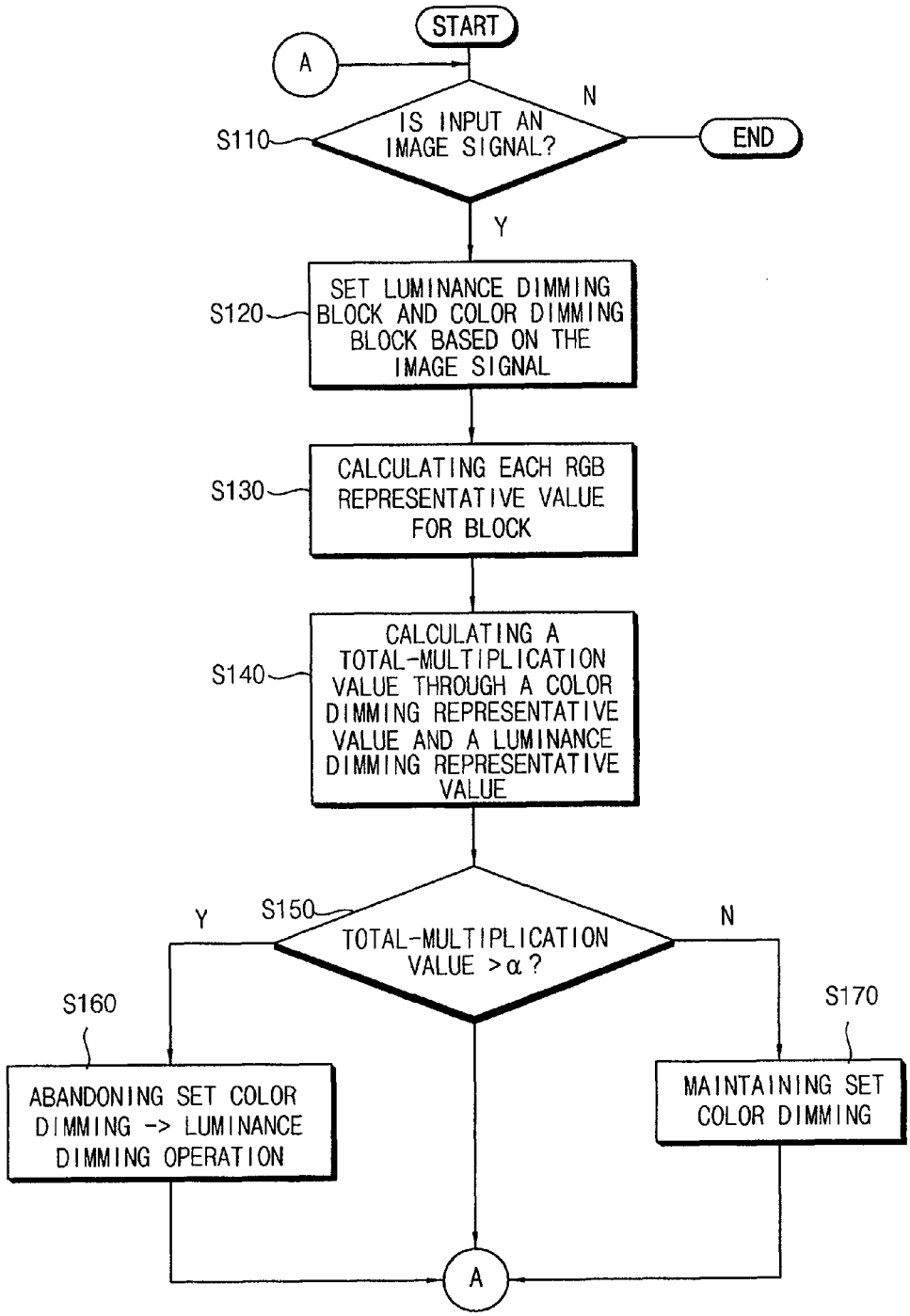
FIG. 6 is a flowchart schematically illustrating a method of controlling an LCD apparatus having an adaptive dimming function according to an embodiment of the present invention.

FIG. 6 is a flowchart schematically illustrating a method of controlling an LCD apparatus having an adaptive dimming function according to an embodiment of the present invention. Referring to FIG. 6, it may be checked whether an image signal is input or not (step S110). In step S10, the process may be ended when the image signal is not input, and a color dimming block and a luminance dimming block may be set based on a predetermined image signal when the image signal is input (step S120).

Then, RGB representative values for each block are calculated (step S130). For example, a red representative value, a green representative value and a blue representative value that are calculated in an (i, j)-th block may be defined as $\hat{R}_{ij}$, $\hat{G}_{ij}$, and $\hat{B}_{ij}$, respectively. The (i, j)-th block may be a block mapped in (i)-th row and (j)-th column, as in FIG. 3 and FIG. 4.

According to one example embodiment of the present invention, each of the RGB representative values may be a mean value of red color data, a mean value of green color data, and a mean value of blue color data that are corresponding to the same block. The mean value may be, for example, a value for which the average of pixel values is calculated.

According to another example embodiment of the present invention, each of the RGB representative values may be a most-frequent value of red color data, a most-frequent value of green color data and a most-frequent value of blue color data that are corresponding to the same block. The most-frequent value may be, for example, a value which corresponds to the gray-scale value most occupied in a histogram.

According to one example embodiment of the present invention, each of the RGB representative values may be a median value of red color data, a median value of green color data and a median value of blue color data that are corresponding to the same block. The median value may be calculated by a median method. For example, the median value may be an intermediate value for which the largest value and the smallest value are excluded. For example, when red color data are arranged in a size order, the median value may be red color data positioned at a medium rank.

Continuing, a total-multiplication value is calculated using each RGB representative value corresponding to the color dimming blocks and each RGB representative value of the luminance dimming blocks adjacent to the color dimming blocks (step S140). For example, each RGB representative value is obtained in correspondence with one block included in the color dimming block, and each RGB representative value is obtained in correspondence with one block included in the luminance dimming block adjacent to the predetermined block. Then, the representative values of the same color are multiplied with each other, and the multiplied values are added to obtain the total-multiplication value. The above may be described by the following Equation 1.

$$\hat{R}_{ij}\times\hat{R}_{mn}+\hat{G}_{ij}\times\hat{G}_{mn}+\hat{B}_{ij}\times\hat{B}_{mn}\ (ij\neq mn) \qquad \text{(Equation 1)}$$

where $\hat{R}_{ij}$, $\hat{G}_{ij}$, and $\hat{B}_{ij}$ are a red representative value, a green representative value, and a blue representative value that are calculated at (i,j)-th block of a color dimming, respectively, and $\hat{R}_{mn}$, $\hat{G}_{mn}$, and $\hat{B}_{mn}$ are a red representative value, a green representative value, and a blue representative value that are calculated at (m,n)-th block of a luminance dimming, respectively.

The present embodiment is described with a color dimming block and a luminance dimming block. Alternatively, the color dimming block may be replaced with a first dimming block corresponding to a first color class, and the luminance dimming block may be replaced with a second dimming block corresponding to a second color class that is different from the first color class. For example, a color class may be defined as a group of colors mapped in a predetermined area of a color coordinate.

Continuing, it is checked whether a total-multiplication value corresponding to at least one of a luminance dimming block of the luminance dimming blocks adjacent to a color dimming block is greater than a setting value or not (step S150).

In step S150, when the total-multiplication value is greater than the setting value, an operation of the set color dimming is abandoned and a luminance dimming operation is performed (step S160), and then the process is fed back to step S110.

In step S150, when the total-multiplication value is smaller or equal to the setting value, the predetermined set color dimming operation is maintained (step S170), and then the process is fed back to step S110.

As described above, according to an embodiment of the present invention, when a color dimming method is used with local dimming by a luminance dimming method, contrast ratio may be enhanced and power consumption may be decreased. Moreover, color reproducibility may be increased and power consumption may be additionally improved in comparison with the luminance dimming method.

Moreover, according to an embodiment of the present invention, a color determined by RGB representative values of the color dimming blocks may be analyzed case by case, as a case in which color is spread to peripheral luminance dimming blocks and a case in which color is not spread to the peripheral luminance dimming blocks, to maintain or abandon a color dimming operation of the predetermined color dimming block so that color artifacts may be prevented from being generated at the boundary area between the color dimming blocks and the luminance dimming blocks.

The foregoing is illustrative of embodiments of the present disclosure of invention and is not to be construed as limiting thereof Although a few example embodiments have been described, those skilled in the art will readily appreciate in light of the foregoing that many modifications are possible in the example embodiments without materially departing from the novel teachings and advantages of the present disclosure. Accordingly, all such modifications are intended to be included within the scope of the present disclosure of invention as defined in the claims. In the claims, means-plus-function clauses are intended to cover the structures described herein as performing the recited function and not only structural equivalents but also functionally equivalent structures. Therefore, it is to be understood that the foregoing is illustrative of the present disclosure and is not to be construed as limited to the specific example embodiments disclosed, and that modifications to the disclosed example embodiments, as well as other example embodiments, are intended to be included within the scope of the teachings. The present disclosure of invention includes the following claims, with equivalents of the claims to be included therein.

What is claimed is:

1. A method of dimming a light source based on an image signal input from an external device, the method comprising:

setting a plurality of light-emitting parts of a light-emitting panel to a plurality of first dimming blocks corresponding to a first color class of the image signal or a plurality of second dimming blocks corresponding to a second color class of the image signal;

calculating a plurality of red, green, and blue (RGB) representative values from RGB values from the image signal corresponding to each of the first and second dimming blocks;

calculating a total-multiplication value by using the RGB representative values corresponding to the first dimming blocks and the RGB representative values corresponding to one or more second dimming blocks adjacent to the first dimming blocks;

comparing the total-multiplication value with a setting value;

controlling at least one of the first dimming blocks to be operated as a second dimming operation, if the total-multiplication value is greater than the setting value; and controlling at least one of the first dimming blocks to be operated as a first dimming operation, if the total-multiplication value is smaller than or equal to the setting value.

2. The method of claim 1, wherein the total-multiplication value is obtained by multiplying each RGB representative value corresponding to the first dimming blocks and representative values of the same color with respect to each RGB representative value of one or more second dimming blocks adjacent to a predetermined first dimming block, and then adding the multiplied representative values of the same color to each other.

3. The method of claim 1, wherein each of the RGB representative values is one of a mean value of red color data, a mean value of green color data, and a mean value of blue color data in correspondence with the same block.

4. The method of claim 1, wherein each of the RGB representative values is one of a most-frequent value of red color data, a most-frequent value of green color data, and a most-frequent value of blue color data in correspondence with the same block.

5. The method of claim 1, wherein each of the RGB representative values is one of a median value of red color data, a median value of green color data, and a median value of blue color data in correspondence with the same block.

6. A light source apparatus comprising:

a light source panel comprising a plurality of light-emitting parts having a plurality of differently colored light-emitting elements, and having a corresponding light emitting area which is divided into a predetermined number of partial areas;

a light source driving part configured to provide each of the light-emitting elements with a respective drive current; and an adaptive dimming control part configured to receive an image signal from an external source and to selectively configure the light-emitting parts as either operating within one of a first plurality of first dimming blocks operating in accordance with a first backlighting color class based on the received image signal or as operating within one of a second plurality of second dimming blocks operating in accordance with a second and different backlighting color class, where said selective configuring is used to control the light source driving part while preventing color artifacts from being generated at boundaries between first dimming blocks operating under the first backlighting color class and second dimming blocks operating under the second backlighting color class, the adaptive dimming control part being configured to control the light source driving part such that at least one of the dimming blocks that was initially slated to operate under the first backlighting color class is switched to instead operate under the second backlighting color class for sake of preventing the color artifact from being generated at the boundaries between the first and second dimming blocks.

7. The light source apparatus of claim 6, wherein the adaptive dimming control part is adapted to:

calculate each of a plurality of red, green, and blue (RGB) representative values based on the received image signal, the calculated values each respectively corresponding to either a respective one of the first backlight dimming blocks that is initially slated to operate in accordance with the first backlighting color class or to a respective one of the second dimming blocks that is initially slated to operate in accordance with the second backlighting color class;

calculate a respective total-multiplication value that is a summed cross product of the RGB representative values corresponding to a boundary one of the first dimming blocks operating in accordance with the first backlighting color class and corresponding to a second dimming block adjacent to the boundary one of the first dimming blocks and operating in accordance with the second backlighting color class; and selectively control the backlight driving part such that if the respective total-multiplication value is greater than a predetermined threshold value, a backlighting mode of the respective boundary one of the first dimming blocks is switched so that the boundary one of the first dimming blocks instead operates in accordance with the second backlighting color class.

8. The light source apparatus of claim 7 wherein each of the RGB representative values is one of a mean value of red color data, a mean value of green color data, and a mean value of blue color data in correspondence with the same block.

9. The light source apparatus of claim 7 wherein each of the RGB representative values is one of a most-frequent value of red color data, a most-frequent value of green color data, and a most-frequent value of blue color data in correspondence with the same block.

10. The light source apparatus of claim 7 wherein each of the RGB representative values is one of a median value of red color data, a median value of green color data, and a median value of blue color data in correspondence with the same block.

11. The light source apparatus of claim 6, wherein:

the light-emitting part comprises a red light-emitting diode (LED), a green LED, and a blue LED; and the first backlighting color class is a color dimming mode which emits a colored rather than a white backlighting light by using one of the red, green, and blue LEDs to a substantially greater extent that than at least one other of the differently colored LEDs.

12. The light source apparatus of claim 11 wherein:

the light-emitting part comprises a red LED, a green LED, and a blue LED; and the second backlighting color class is a luminance dimming mode which emits a white light by using the red, green, and blue LEDs all to substantially equal extents.

13. A liquid crystal display (LCD) apparatus comprising:

an LCD panel configured to display images using a liquid crystal layer;

a backlight assembly comprising a plurality of light-emitting parts having a plurality of light-emitting elements, and having a corresponding light emitting area which is divided into a predetermined number of partial areas, the backlight assembly being configured to provide the LCD panel with at least one of a non-white backlighting light and a white backlighting light; and an adaptive dimming control part configured to receive an image signal from an external source and to initially designate the light-emitting parts as either operating within one of a first plurality of first dimming blocks operating in accordance with a first backlighting color class based on the received image signal or as operating within one of a second plurality of second dimming blocks operating in accordance with a second and different backlighting color class, where said initial designating is used to control the backlight assembly while preventing color artifacts from being generated at boundaries between first dimming blocks operating under the first backlighting color class and second dimming blocks operating under the second backlighting color class, the adaptive dimming control part being configured to control the backlight assembly such that at least one of the dimming blocks that was initially designated to operate under the first backlighting color class is switched to instead operate under the second backlighting color class for preventing a color artifact from being generated at a boundary between the first and second dimming blocks.

14. The LCD apparatus of claim 13, wherein the adaptive dimming control part is adapted to:

calculate each of a plurality of red, green, and blue (RGB) image representative values based on the received image signal, the calculated values each respectively corresponding to either a respective one of the first dimming blocks that is initially designated to operate in accordance with the first backlighting color class or to a respective one of the second dimming blocks that is initially designated to operate in accordance with the second backlighting color class;

calculate a respective total-multiplication value that is a summed cross product of the RGB representative values corresponding to a boundary one of the first dimming blocks operating in accordance with the first backlighting color class and corresponding to a second dimming block adjacent to the boundary one of the first dimming blocks and operating in accordance with the second backlighting color class; and selectively control the backlight assembly such that if the respective total-multiplication value is greater than a predetermined threshold value, a backlighting mode of the respective boundary one of the first dimming blocks is switched so that the boundary one of the first dimming blocks instead operates in accordance with the second backlighting color class.

15. The LCD apparatus of claim 14, wherein each of the RGB representative values is one of a mean value of red color data, a mean value of green color data, and a mean value of blue color data in correspondence with the same block.

16. The LCD apparatus of claim 14, wherein each of the RGB representative values is one of a most-frequent value of red color data, a most-frequent value of green color data, and a most-frequent value of blue color data in correspondence with the same block.

17. The LCD apparatus of claim 14, wherein each of the RGB representative values is one of a median value of red color data, a median value of green color data, and a median value of blue color data in correspondence with the same block.

18. The LCD apparatus of claim 13, wherein:

the light-emitting part comprises a red LED, a green LED, and a blue LED; and the first backlighting color class is a color dimming mode which emits a colored rather than a white backlighting light by using one of the red, green, and blue LEDs to a substantially greater extent that than at least one other of the differently colored LEDs.

19. The LCD apparatus of claim 18, wherein:

the light-emitting part comprises a red LED, a green LED, and a blue LED; and the second backlighting color class is a luminance dimming mode which emits a white light by using the red, green, and blue LEDs all to substantially equal extents.

* * * * *